US005517206A

United States Patent [19]

Boone et al.

[11] Patent Number: 5,517,206

[45] Date of Patent: May 14, 1996

[54] BROAD BAND ANTENNA STRUCTURE

[75] Inventors: Theresa C. Boone; Russell W. Johnson, both of Boulder; Farzin Lalezari, Louisville, all of Colo.

[73] Assignee: Ball Corporation, Muncie, Ind.

[21] Appl. No.: 737,788

[22] Filed: Jul. 30, 1991

[51] Int. Cl.[6] ..... H01Q 9/16; H01Q 1/36; H01Q 11/10

[52] U.S. Cl. ..... 343/806; 343/895; 343/792.5

[58] Field of Search ..... 343/806, 895, 343/792.5, 853, 711, 821

[56] References Cited

U.S. PATENT DOCUMENTS

| | | | |
|---|---|---|---|
| 1,910,147 | 5/1933 | Bruce | 343/806 |
| 2,759,183 | 8/1956 | Woodward, Jr. | 343/806 |
| 3,019,439 | 1/1962 | Reis et al. | 343/853 |
| 3,039,099 | 6/1962 | Chait et al. | 343/851 |
| 3,106,714 | 10/1963 | Minerva | 343/792.5 |
| 3,231,894 | 1/1966 | Nagai | 343/806 |
| 3,355,740 | 11/1967 | Mayes | 343/792.5 |
| 3,454,951 | 7/1969 | Patterson et al. | 343/895 |
| 3,465,346 | 9/1969 | Patterson et al. | 343/895 |
| 3,521,289 | 7/1970 | Mayes et al. | 343/806 |
| 3,573,840 | 4/1971 | Gouillou | 343/895 |
| 3,745,585 | 7/1973 | Barbano | 343/792.5 |
| 4,038,662 | 7/1977 | Turner | 343/752 |
| 4,243,993 | 1/1981 | Lamberty et al. | 343/895 |
| 4,381,566 | 4/1983 | Kane | 343/806 |
| 4,644,366 | 2/1987 | Scholz | 343/895 |
| 4,742,359 | 5/1988 | Ishino et al. | 343/895 |
| 4,835,541 | 5/1989 | Johnson et al. | 343/713 |
| 5,313,216 | 5/1994 | Wang et al. | 343/792.5 |

FOREIGN PATENT DOCUMENTS

| | | | |
|---|---|---|---|
| 0453485 | 12/1948 | Canada | 343/806 |
| 0571311 | 2/1959 | Canada | 343/895 |

OTHER PUBLICATIONS

Chapter 14 of the *Antenna Engineering Handbook* by Johnson and Jasik, 2nd Edition (McGraw–Hill, 1984) entitled "Frequency–Independent Antennas" by DuHamel and Chadwick.

*Primary Examiner*—Donald T. Hajec
*Assistant Examiner*—Tan Ho
*Attorney, Agent, or Firm*—Gilbert E. Alberding

[57] ABSTRACT

An antenna structure is provided having one or more spiral antenna arms extending outwardly from a lateral center axis. Each arm is defined by an antenna element disposed in a zig-zag configuration to provide reactive loading to the arm, wherein each arm receives or transmits radio frequency waves about a longitudinal center axis of the arm and the zig-zag element configuration. Thus, the antenna structure has a broader bandwidth than other antennas requiring the same amount of space. The antenna structure also has a substantially omni-directional radiation pattern and a low profile. Each antenna element can be metallisation disposed on a support structure or can be one or more cable conductors. A feed means is provided which can be connected to the elements proximate to the lateral center axis and positioned along or coincident with the longitudinal center axis of one arm or can be connected to one of the elements distal to the lateral center axis. In both methods of feeding the antenna arms, the antenna elements function as part of an infinite balun. In one application, the antenna structure is secured within the non-metallic roof structure of an automobile.

46 Claims, 4 Drawing Sheets

BROAD BAND ANTENNA STRUCTURE

TECHNICAL FIELD OF THE INVENTION

This invention relates in general to antenna structures, and in particular to a low-profile, omni-directional, broadband antenna.

BACKGROUND OF THE INVENTION

There is a rapidly expanding need for omni-directional radio frequency antennas (i.e., having a radiation pattern with substantially constant gain over approximately 360° of coverage in the azimuthal plane and at substantially all degrees of elevation). Such a capability obviates the need for physically or electrically scanning a directive antenna in order to communicate with systems located in various directions. Such a capability also obviates the need for aiming a non-scanning directive antenna in the general direction of several radio frequency systems in an attempt to acquire adequate communications with all of them.

The desirability for omni-directional antennas is particularly apparent in mobile applications in which it is intended that the mobile radio system communicate with one or more different remote (mobile or fixed) systems as the mobile unit changes direction and location relative to the other systems. For example, it can be appreciated that a portable cellular telephone should have an omni-directional antenna to enhance the benefits of portability. It can be impractical, expensive or both to provide a mobile system with an antenna having electrical or physical scanning capabilities.

Broad bandwidth capability is another characteristic which may also be desirable in many of the applications in which an omni-directional pattern is desirable. Such a capability enables a communication system to operate over a number of different frequencies with a single antenna. Many existing antennas which are termed "broadband" are actually designed for operation at a selected center frequency; they may also have adequate performance over some range of frequencies on either side of the center frequency. To enhance performance over a very broad range of frequencies, however, means for manually or electrically tuning such an antenna should be provided. Making manual adjustments every time a frequency change is desired is inconvenient and not particularly reliable, as can be appreciated by anyone who has adjusted and tuned a TV antenna when changing stations. And, automatic electrical tuning requires the inclusion of complex and possibly expensive circuitry, making such an antenna impractical for many applications.

There are also many applications in which small size is a desirable feature, such as, for example, mobile applications in which the amount of space in which to mount an antenna is limited. For cosmetic, security and aerodynamic reasons, a low profile may be also desirable. It is preferable that the antenna feed (such as a coaxial cable connecting the antenna with a receiver or transmitter) not substantially affect the size or profile of the antenna. Therefore, it may be necessary to run the feed cable along one surface of the antenna itself. However, such a configuration can create coupling between the feed line and the antenna which can be detrimental to the performance of the antenna.

While numerous types of antennas have been proposed to address the foregoing desired characteristics, none have heretofore been able to adequately satisfy all of the characteristics in a single package.

OBJECTS OF THE INVENTION

It is an object of the present invention to provide an antenna structure having a substantially omni-directional radiation pattern.

It is a further object of the present invention to provide such an antenna structure with broad bandwidth capabilities.

It is still a further object of the present invention to provide such an antenna structure which is small, has a low profile, and is easy and inexpensive to manufacture.

SUMMARY OF THE INVENTION

In accordance with the present invention, an antenna structure is provided having a spiral antenna arm for receiving radio frequency waves, the antenna arm being defined by an antenna element disposed in a zig-zag configuration. The spiral shape defined by the element and the zig-zag configuration allows for omni-directional operation and provides reactive loading to the antenna arm to extend the bandwidth of the antenna structure without increasing its size. The antenna structure also includes a feed means for conducting radio frequency signals from the antenna element to a receiver.

The antenna structure can also include a second spiral antenna arm defined by a second antenna element disposed in the zig-zag configuration. The antenna arms extend outwardly in opposite directions from a common lateral center axis. The spiral shapes defined by the elements and the zig-zag configuration allow the antenna structure to receive, and, if desired, transmit, radio frequency signals about a longitudinal center axis extending outwardly along the arms from a lateral center axis, thereby providing production and performance advantages over other antennas. The spiral shape of the arms can be an equiangular spiral and the zig-zag configuration of the elements can be a logarithmic periodic zig-zag to enhance the broadband capabilities of the antenna structure. Further, each antenna element can comprise a single conductor whereby received radiation generates currents in each arm.

In one embodiment of the present invention, each of the antenna elements comprise metallization disposed on a surface of an insulating support member, such as by printing. The feed means can include a coaxial cable with an inner conductor connected to end of one of the two antenna elements proximate to the lateral center axis of the spiral arms and the outer conductor connected to the proximate end of the other of the two antenna elements. To reduce adverse coupling between the feed line and the antenna arms, the coaxial cable is positioned substantially coincident with the longitudinal center axis of one of the two antenna arms. Such a configuration also enables the antenna structure to maintain a low profile.

In another embodiment, one of the antenna elements comprises the outer conductor of a coaxial cable. The end of this outer conductor at the outer end of the antenna arm (i.e., distal to the lateral center axis of the antenna arms) is connected to one conductor of the feed line. The distal end of the inner conductor of the coaxial cable is connected to another conductor of the feed line. Proximate to the center lateral axis, the center conductor of the coaxial cable is connected to the other antenna element. Since the feed cable is connected at an outer location on an antenna arm, the antenna structure can maintain a low profile. Such a configuration also permits the antenna to be coupled to the receiver through an infinite balun which includes the coaxial cable of which one of the antenna elements is a part.

In yet another embodiment, the feed means can include a coaxial cable with the inner and outer conductors connected to the proximate ends of the two antenna elements. To reduce coupling between the feed lines and the antenna arms, and therefore reduce perturbations in the radiation pattern, the feed line conductors are positioned substantially coincident with a longitudinal center axis of one of the two antenna arms.

In one application of the present invention, an antenna structure is disposed within the limited space of the roof structure of an automobile. To facilitate the broadband, omni-directional capabilities of the antenna structure, the roof and the headliner between which the antenna structure is secured should be non-metallic. The antenna elements can be metallization disposed on a surface of a support member. The feed cable is positioned on one surface of the support member substantially along the longitudinal center axis of one of the arms, thus enhancing the antenna's low profile. The arms and zig-zag antenna elements can be dimensioned to provide good reception of AM and FM radio transmissions and VHF and UHF television transmissions even as the automobile changes location and position.

The antenna structure of the present invention has a substantially omni-directional radiation pattern and has a broad band of operating frequencies. The antenna structure is easy and inexpensive to manufacture and has a low profile, making it particularly advantageous for use in a mobile application where small size, light weight, omni-directional, broad bandwidth and low profile may all be desirable features.

BRIEF DESCRIPTION OF THE DRAWINGS

For a more complete understanding of the present invention and the advantages thereof, reference is now made to the following detailed description taken in conjunction with the accompanying drawings, in which.

DETAILED DESCRIPTION OF THE PREFERRED EMBODIMENT

Figure 1:
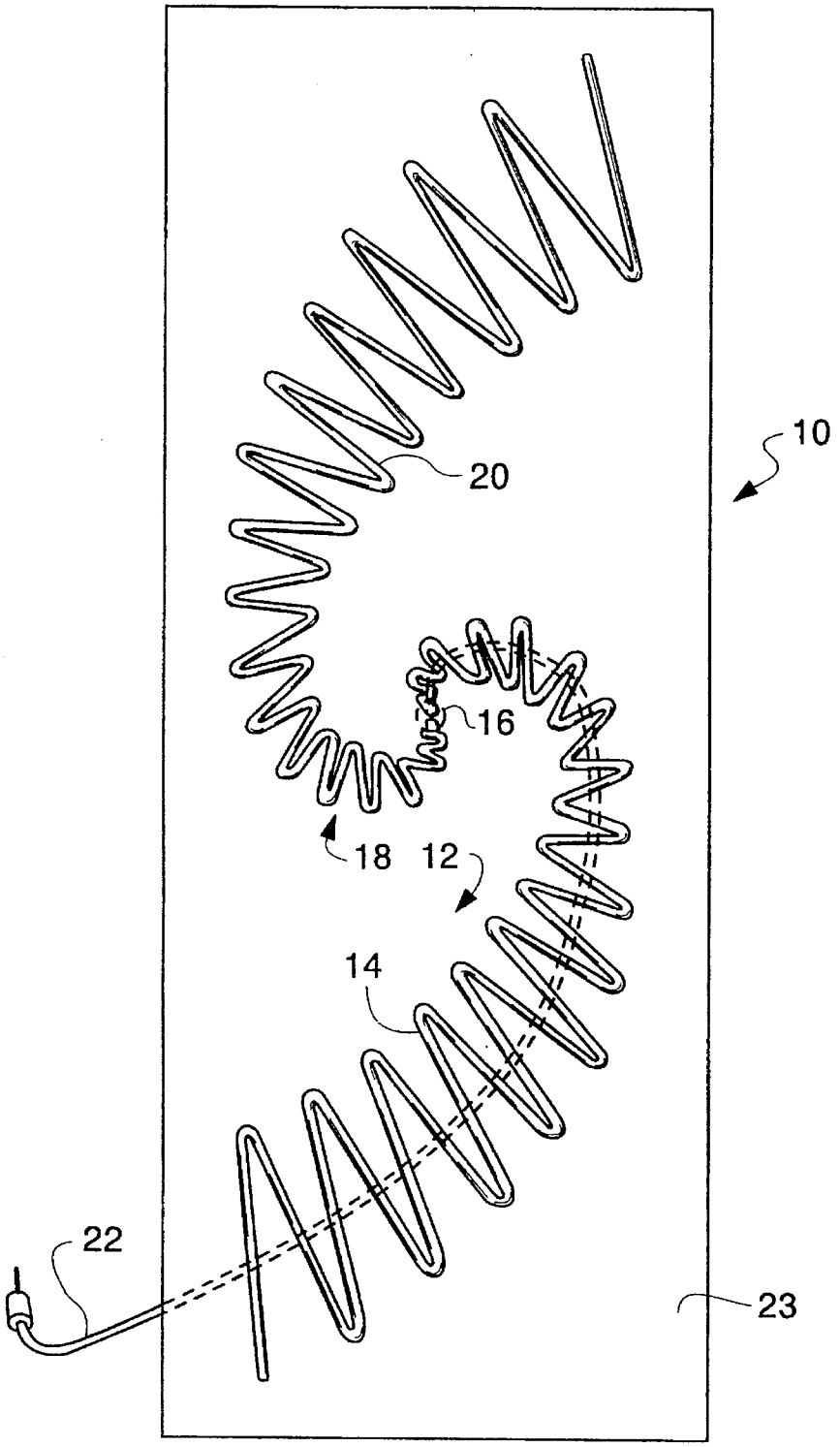
FIG. 1 illustrates one embodiment of the antenna structure of the present invention.

FIG. 1 illustrates one embodiment of an antenna structure 10 of the present invention comprising of an antenna arm 12 for receiving radio frequency waves and having a spiral shape. Antenna arm 12 is defined by an antenna element 14 having a zig-zag configuration extending outwardly from a lateral center axis perpendicular to antenna structure 10 and which, for clarity in FIG. 1, is represented by a dashed circle 16. Antenna structure 10 can also include a second antenna arm 18 having substantially the same spiral shape as first antenna arm 12. Antenna arm 18 is defined by a second antenna element 20 disposed in substantially the same zig-zag configuration as first antenna element 14 and extending outwardly from lateral center axis 16.

Antenna structure 10 also includes a feed means, such as a cable 22, for connecting antenna structure 10 to a radio frequency receiver. (Although antenna structure 10 is described herein as being connected to a receiver for reception of radio frequency waves, it can also be coupled to a transmitter for transmission of radio frequency waves and the invention is not limited to any one particular mode of operation.) Preferably, first and second antenna arms 12 and 18 extend outwardly in opposite directions from center lateral axis 16. Thus, a particular point on first antenna arm 12 is physically about 180° from a corresponding point on second antenna arm 18. First and second antenna elements 14 and 20 are electrically coupled to the receiver in such a fashion as to be about 180° out of phase. The combination of the physical and electrical phase differences causes antenna structure 10 to have substantially constant gain in the hemisphere above antenna structure 10. When first and second antenna arms 12 and 18 are substantially coplanar, the radiation pattern of antenna structure 10 is also bi-directional, (i.e., in the two directions perpendicular to antenna structure 10) thereby providing antenna structure 10 with substantially spherical coverage.

In the embodiment illustrated in FIG. 1, antenna elements 14 and 20 comprise metallization on a surface of an insulating support member 23. Such metallization can be disposed on support member 23 using any of a variety of conventional methods, such as photo-etching or silk-screen printing, thereby enhancing production efficiency. Cable 22 is positioned on one surface of support member 23 along or coincident with the longitudinal center axis of one of the antenna arms, as illustrated in phantom in FIG. 1. The inner and outer conductors of cable 22 are brought through an opening in support member 23 located at or near lateral center axis 16. One of the two conductors is electrically connected to antenna element 14 and the other is electrically connected to antenna element 20. Such an arrangement enables antenna structure 10 to maintain a low profile and the proximity of cable 22 to antenna arm 12 will not cause significant coupling between the two which would adversely affect the broadband, omni-directional performance of antenna structure 10. Although in FIG. 1, cable 22 is shown positioned on the surface of support member 23 opposite the surface on which antenna elements 14 and 20 are disposed, cable 22 can alternatively be positioned on the same surface as antenna elements 14 and 20 and electrically insulated therefrom. Further, antenna elements 14 and 20 can be disposed on the opposite surfaces of support member 23 with cable 22 positioned on either surface and electrically insulated therefrom.

In operation, the spiral shape of first and second antenna arms 12 and 18 contributes to the broadband capabilities of antenna structure 10. Such bandwidth can be extended further without increasing the size of antenna structure 10 by providing reactive loading to first and second antenna arms 12 and 18. This reactive loading is achieved by disposing first and second antenna elements 14 and 20 in a zig-zag configuration to define first and second antenna arms 12 and 18, respectively. Because of the reactive loading, first and second antenna arms 12 and 18 perform electrically as if they were solid spiral arms in which received radiation generates currents (and, when antenna structure 10 is employed as a transmitting antenna, currents in the arms provide the radiation). The electrical or effective length of the arms is longer than their physical lengths (as measured along a longitudinal center axis on each arm extending outwardly from lateral center axis 16). Consequently, the bandwidth of antenna structure 10 is extended. The upper frequency of the bandwidth of antenna structure 10 is substantially determined by the width of each antenna arm at a location proximate to lateral center axis 16. The lower frequency of the bandwidth is substantially determined by the effective length of each antenna arm 12 and 18 from a location proximate to lateral center axis 16 to a location distal to lateral center axis 16.

Figure 2:
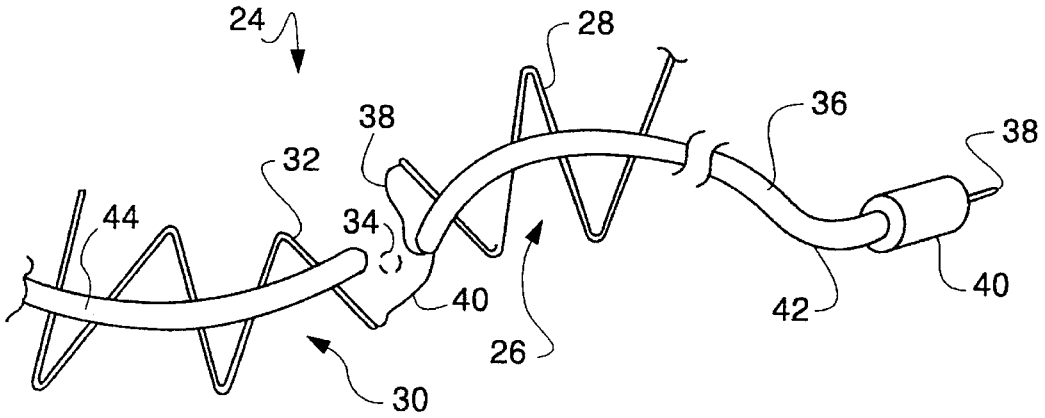
FIG. 2 illustrates a feed means for the antenna structure of the present invention.

FIG. 2 illustrates in more detail the method of feeding an antenna structure discussed with respect to FIG. 1. An antenna structure 24, only a portion of which is shown in FIG. 2, includes a first antenna arm 26 having a spiral shape and being defined by first antenna element 28 disposed in a zig-zag configuration, and a second antenna arm 30 having substantially the same spiral shape and being defined by a second antenna element 32 disposed in substantially the same zig-zag configuration. First and second antenna arms 26 and 30 extend outwardly in substantially opposite directions from a lateral center axis, which for clarity is represented in FIG. 2 as a dashed circle 34.

Antenna structure 24 also includes a feed means, such as a coaxial cable 36 having an inner conductor 38 and an outer conductor 40 substantially surrounding and shielding inner conductor 38. Preferably, outer conductor 40 is surrounded by an insulating layer 42 to prevent outer conductor 40 from coming into electrical contact with first antenna element 28. The end of inner conductor 38 proximate to lateral center axis 34 is connected to the proximate end of first antenna element 28 and the end of outer conductor 40 which is proximate to lateral center axis 34 is electrically connected to the proximate end of second antenna element 32. Preferably, coaxial cable 36 is positioned substantially along, or coincident with, a longitudinal center axis of first antenna arm 26 to ensure that any energy radiating from coaxial cable 36 is substantially perpendicular to energy radiating from first antenna arm 26. Consequently, the radiation pattern from first antenna arm 26 will not be substantially perturbed by energy in coaxial cable 36. In order that the radiation pattern of antenna structure 24 be substantially symmetrical around lateral center axis 34, a "dummy" cable 44 can be disposed along the longitudinal center axis of second antenna arm 30 and left unconnected.

Figure 3:
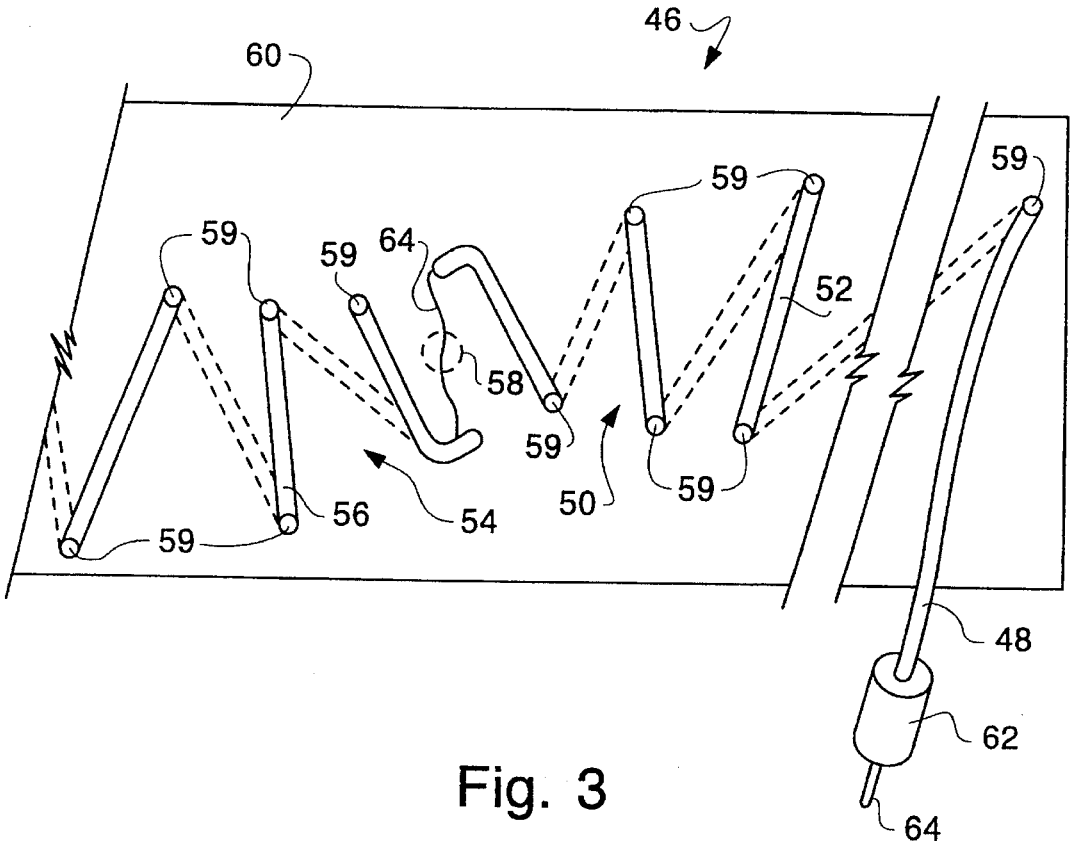
FIG. 3 illustrates an alternative feed means for the antenna structure of the present invention.

FIG. 3 illustrates another method of coupling an antenna structure 46, only a portion of which is shown in FIG. 3, with a receiver through a feed means, such as a coaxial cable 48. Antenna structure 46 includes a first antenna arm 50 having a spiral shape and being defined by a first antenna element 52 disposed in a zig-zag configuration, and a second antenna arm 54 having substantially the same spiral shape and being defined by a second antenna element 56 disposed in substantially the same zig-zag configuration. First and second antenna arms 50 and 54 extend outwardly from a lateral center axis, shown for clarity as a dashed circle 58.

In the embodiment illustrated in FIG. 3, first and second antenna elements 52 and 56 are woven through openings 59 in a support member 60. Thus, one portion of each antenna element 52 and 56 is disposed on one surface of support member 60 while the remaining portion of each (shown in phantom in FIG. 3) is disposed on the opposing surface of support member 60. Alternatively, first and second antenna elements 52 and 56 can be disposed entirely on one surface of support member 60 or, first antenna element 52 can be disposed on one surface of support member 60 and second antenna element 56 disposed on the opposing surface.

Coaxial cable 48 includes an outer conductor 62 and an inner conductor 64. First antenna element 52 comprises the outer conductor of a coaxial cable and is electrically connected to, or is a continuation of, outer conductor 62 of coaxial cable 48. Inner conductor 64 is surrounded by first antenna element 52 and is electrically connected to, or is a continuation of, inner conductor 64 of coaxial cable 48. First antenna element 52 ends proximate to lateral center axis 58. Inner conductor 64 extends from the center of first antenna element 52 and is electrically connected to the end of second antenna element 56 proximate to lateral center axis 58. For ease of construction, second antenna element 56 can also be the outer conductor of a coaxial cable, the inner conductor of which is not used.

The method of feeding antenna structure 46 illustrated in FIG. 3, with coaxial cable 48 being connected to first antenna element 52 at an outer or distal location on first antenna arm 50, enables antenna structure 46 to have a low profile. The feed means does not require space on either surface of support member 60 and does not extend perpendicularly along lateral center axis 58, thereby permitting antenna structure 46 to maintain a low profile. Such a method of feeding antenna structure 46 also substantially reduces coupling between the feed means and first and second antenna arms 50 and 54, thereby substantially reducing adverse effects on the radiation pattern of antenna structure 46.

The feed means described in conjunction with the embodiments illustrated in FIGS. 2 and 3 comprise an infinite balun to enhance impedance matching between a coaxial cable and the antenna structure. Due to the spiral shape of the antenna structure of the present invention, the characteristic impedance of the antenna structure is substantially independent of frequency of operation. When an infinite balun is employed, the antenna structure can be coupled to a radio receiver without a separate tuning network and have broadband capabilities.

With respect to the embodiments illustrated in the Figures, the spiral shape of the two antenna arms can be an equiangular spiral and the zig-zag configuration of the antenna elements defining the spiral arms can be a logarithmic periodic zig-zag configuration. Thus the frequency independent and broadband characteristics of the antenna structure are enhanced, including further extending the upper operating frequency of the antenna structure.

Figure 4:
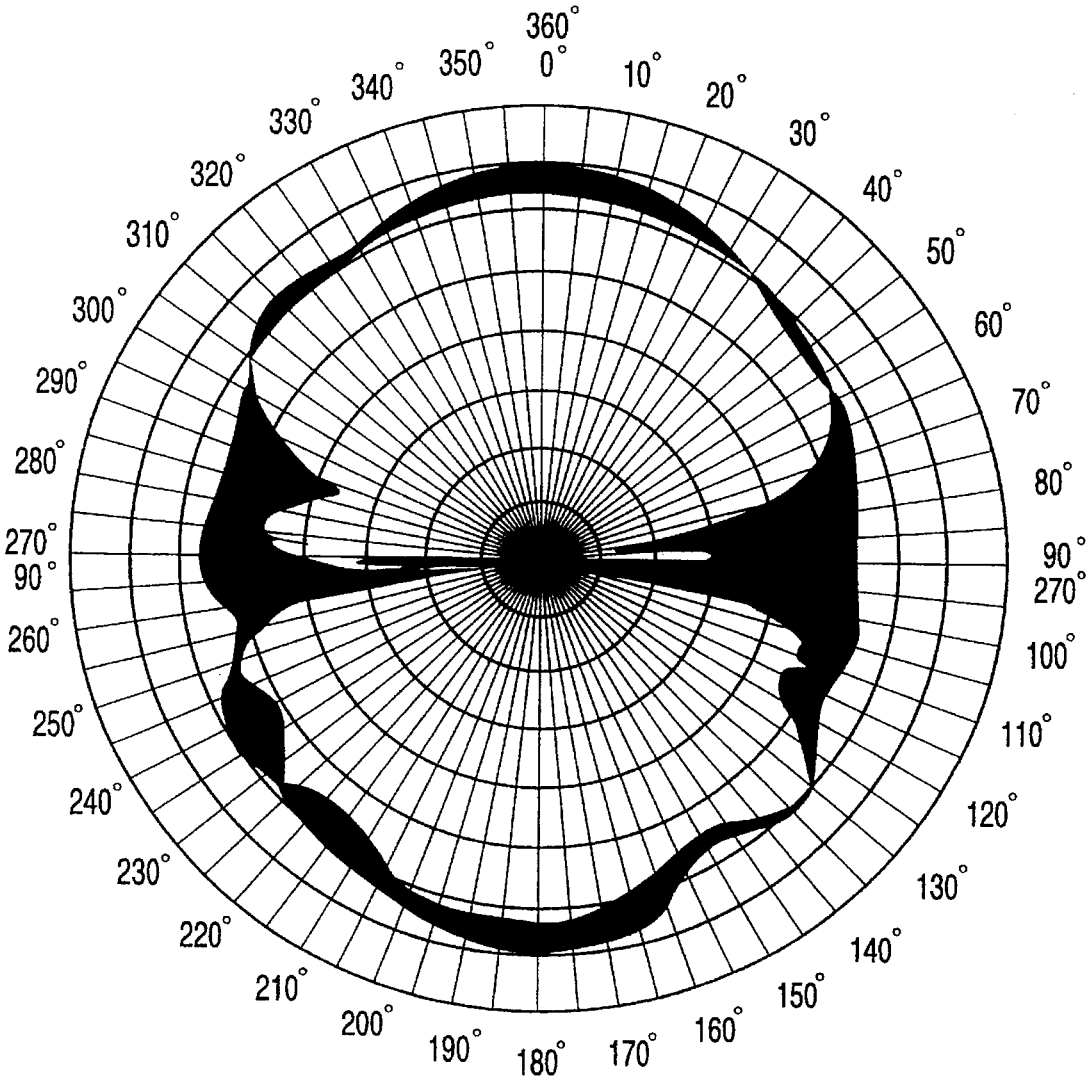
FIG. 4 illustrates a predicted elevation plane radiation pattern of an antenna structure of the present invention.

An exemplary antenna structure has been constructed in which the effective length of each arm at a location distal to the lateral center axis was selected to provide the antenna structure with a lower operating frequency of about 50 MHz. The width of each antenna arm proximate to the lateral center axis was selected to provide the antenna structure with an upper operating frequency of about 900 MHz. This band of operation covers the lower and upper VHF television bands (54–88 MHz and 174–216 MHz, respectively), the UHF television band (470–890 MHz) and the FM radio band (88–108 MHz). The exemplary antenna structure also provides good reception in the AM radio band (500–1600 KHz). A predicted radiation pattern of the exemplary antenna structure, with changing elevation, is illustrated in FIG. 4 and demonstrates the substantially omni-directional capability of the present invention. By comparison, it is anticipated that a two-arm spiral antenna having solid arms (i.e., no zig-zag) with the same area as the exemplary antenna structure is unable to provide satisfactory reception of television or radio signals below about 180 MHz.

The configuration of the antenna structure of the present invention also provides a further advantage by reducing multipath which can cause the familiar "ghosting" on a TV screen. Multipath interference is substantially reduced because the spiral arms of the antenna structure select radio waves having one sense of circular polarization (for example, right-hand circular polarization for television and FM radio reception) while rejecting radio frequency waves having the opposite sense of circular polarization (such as left-hand circular polarization) which have been reflected by objects, such as buildings.

Figure 5B:
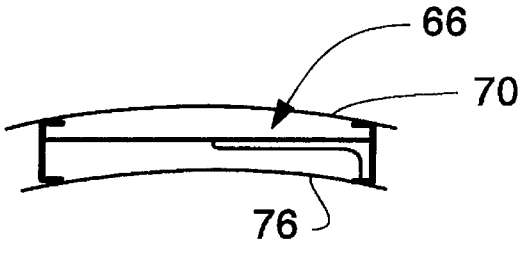
FIGS. 5*a* and 5*b* illustrate the use of the present invention in a mobile system application.
Figure 5A:
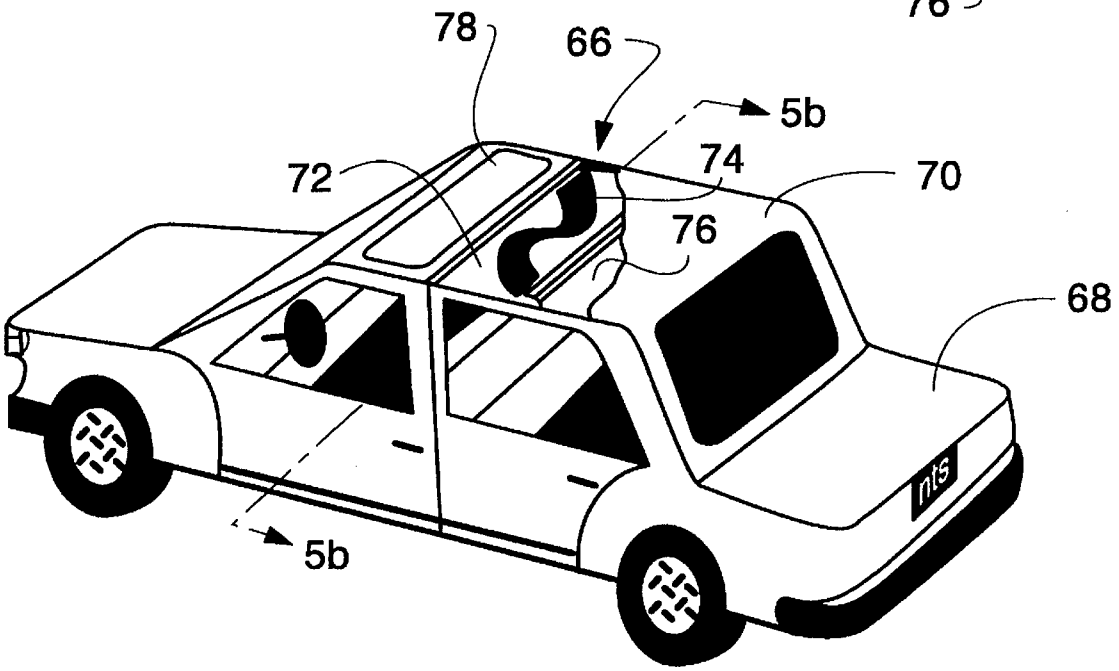

FIGS. 5*a* and 5*b* illustrate an application of the present invention in which an antenna structure 66 is installed in an automobile 68. The roof 70, which should be non-metallic, of automobile 68 has been partially cutaway to show antenna structure 66. Antenna structure 66 includes a support member 72 on which two antenna arms 74 have been disposed. Antenna arms 74 have a spiral shape and are defined by antenna elements disposed in a zig-zag fashion, as discussed in detail with respect to the embodiments illustrated in FIGS. 1, 2 and 3. Support member 72 can be made of any non-metallic or insulating material, such as teflon-fiberglass. Teflon-fiberglass also provides additional dielectric loading to the antenna structure, thereby lowering the lower frequency of operation. The antenna elements can be metallization disposed on a surface of support member 72, such as by photo-etching or printing.

FIG. 5*b* is a cross-sectional view of antenna structure 66 positioned between a non-metallic headliner 76 and non-metallic roof 70. A feed line 77 is positioned on support member 72 along the longitudinal center axis of one of arms 74 and is connected to the two antenna elements proximate to the lateral center axis of spiral arms 74. Such an arrangement enables antenna structure 66 to maintain a low profile and substantially reduces coupling between antenna arms 74 and feed line 77, as discussed with respect to FIGS. 1 and 2.

The entire roof structure of automobile 68 which is above and below antenna structure 66 is preferably non-metallic in order that the radiation pattern of antenna structure 66 be substantially omni-directional and that the bandwidth of antenna structure 66 not be decreased. Therefore, roof 70, surrounding and overlying antenna structure 66, can be formed of fiberglass or other similar material which is both insulating and substantially transparent to radio frequency waves. If desired, a portion of the roof structure of automobile 68 can include a sunroof 78 or similar non-metallic panel without adversely affecting the performance of antenna structure 66. It is also believed that metal panels or frame members around antenna structure 66 (i.e., outside the perimeter of support structure 72) will not adversely affect the performance of antenna structure 66.

In operation, as automobile 68 changes location and direction relative to a radio or television transmitter, the omni-directional radiation pattern of the antenna structure 66 enables satisfactory reception of radio and television signals. The low profile and small size of antenna structure 66 permit it to be concealed in the roof structure of automobile 68. When appropriately dimensioned, the spiral shape of arms 74 and the zig-zag configuration of the antenna elements enable antenna structure 66 to have broad bandwidth capabilities covering the AM and FM radio bands and the upper and lower VHF and UHF television bands in spite of the limited area available on roof 70.

Although the present invention has been described in detail, it should be understood that various changes, substitutions and alterations can be made herein without departing from the spirit and scope of the invention as defined by the claims set forth herein. For example, although the embodiments illustrated in FIGS. 1–4 include two antenna arms, more than two antenna arms can be included, disposed substantially uniformly around the lateral center axis and having substantially uniform phase differences. Furthermore, an antenna structure of the present invention can be constructed with a single arm having a spiral shape defined by an antenna element disposed in a zig-zag fashion. Such an arm can be mounted orthogonally to a ground plane. Additionally, the spiral arms can be configured to accommodate perimeters having shapes other than rectangular, such as various other polygons, and circular or oval shapes.

What is claimed is:

1. An antenna structure, comprising:

a first antenna arm for receiving radio frequency waves, said first antenna arm having a first spiral shape and being defined by a first antenna element disposed in a first zig-zag configuration that has a logarithmic periodic characteristic and extends outwardly from a lateral center axis, said logarithmic periodic characteristic contributing to the determination of a first bandwidth of said first antenna arm, wherein said first antenna arm receives said radio frequency waves about a first longitudinal center axis of said first antenna arm and said first zig-zag antenna element configuration; and feed means for conducting radio frequency signals from said first antenna element.

2. The antenna structure of claim 1, further including:

a second antenna arm for receiving radio frequency waves, said second antenna arm having a second spiral shape and being defined by a second antenna element disposed in a second zig-zag configuration extending outwardly from said lateral center axis of said first antenna arm to provide reactive loading to said second antenna arm, wherein said second antenna arm receives said radio frequency waves about a second longitudinal center axis of said second antenna arm and said second zig-zag antenna element configuration; and said first and second antenna arms are disposed substantially uniformly about said lateral center axis.

3. The antenna structure of claim 2, wherein:

said first antenna element has a first proximate end located proximate to said lateral central axis and a first distal end located distal to said lateral central axis; and said second antenna element has a second proximate end located proximate to said lateral central axis and a second distal end located distal to said lateral central axis;

said feed means includes a feed coaxial cable having a feed inner conductor and a feed outer conductor that is electrically insulated from said feed inner conductor.

4. The antenna structure of claim 3, wherein:

said feed inner conductor of said feed coaxial cable is electrically connected to one of the following: said first proximate end of said first antenna element and said second proximate end of said second antenna element;

said feed outer conductor of said feed coaxial cable is electrically connected to the other of said first proximate end of said first antenna element and said second proximate end of said second antenna element; and said feed coaxial cable being positioned substantially coincident with one of the following: said first longitudinal center axis of said first antenna arm and said second longitudinal axis of said second antenna arm.

5. The antenna structure of claim 4, said feed means further comprising:

a dummy coaxial cable positioned substantially coincident with the other of said first longitudinal center axis of said first antenna arm and said second longitudinal center axis of said second antenna arm.

6. The antenna structure of claim 4 wherein:

said first antenna element comprises a first outer conductor of a first coaxial cable; and said second antenna element comprises a second outer conductor of a second coaxial cable.

7. The antenna structure of claim 6, further including an insulating support member wherein:

one of said first and second coaxial cables is woven through multiple openings in said support member.

8. The antenna structure of claim 2, wherein:

said first antenna element comprises a first metallization disposed on a surface of an insulating support member; and said second antenna element comprises a second metallization disposed on said surface of said support member.

9. The antenna structure of claim 2, said feed means comprising an infinite balun.

10. The antenna structure of claim 2, wherein said first and second antenna elements are disposed in a substantially coplanar fashion whereby the antenna structure achieves a substantially spherical radiation pattern.

11. The antenna structure of claim 2 wherein said first and second antenna elements are capable of receiving radio frequency energy over a band having an upper frequency and a lower frequency, said upper frequency being substantially determined by the width of each of said first and said second antenna arms at a location proximate to said lateral center axis and said lower frequency being substantially determined by the effective length of each of said first and said second antenna arms at a location distal to said lateral center axis.

12. The antenna structure of claim 2 wherein said first and second antenna elements are capable of receiving radio frequency energy over a band having an upper frequency of about 900 MHz and a lower frequency of about 50 MHz, said upper frequency being substantially determined by the width of each of said first and said second antenna arms at a location proximate to said lateral center axis and said lower frequency being substantially determined by the effective length of each of said first and said second antenna arms at a location distal to said lateral center axis.

13. The antenna structure of claim 1 wherein said first spiral shape is an equiangular spiral and the width of said first antenna arm increases logarithmically with increasing distance from said lateral center axis.

14. The antenna structure of claim 1 wherein said first antenna element comprises a single conductor.

15. The antenna structure of claim 1 wherein said feed means is coupled to transmitting means whereby said first antenna arm is capable of transmitting radio frequency waves.

16. An antenna structure, comprising:

a first antenna arm for receiving radio frequency waves, said first antenna arm having a first spiral shape and being defined by a first antenna element disposed in a first zig-zag configuration extending outwardly from a lateral center axis to provide reactive loading to said first antenna arm, wherein said first antenna arm receives said radio frequency waves about a first longitudinal center axis of said first antenna arm and said first zig-zag antenna element configuration; and feed means for conducting radio frequency signals from said first antenna element;

a second antenna arm for receiving radio frequency waves, said second antenna arm having a second spiral shape and being defined by a second antenna element disposed in a second zig-zag configuration extending outwardly from said lateral center axis of said first antenna arm to provide reactive loading to said second antenna arm, wherein said second antenna arm receives said radio frequency waves about a second longitudinal center axis of said second antenna arm and said second zig-zag antenna element configuration;

said first and second antenna arms are disposed substantially uniformly about said lateral center axis;

said first antenna element has a first proximate end located proximate to said lateral central axis and a first distal end located distal to said lateral central axis;

said second antenna element has a second proximate end located proximate to said lateral central axis and a second distal end located distal to said lateral central axis;

said feed means includes a feed coaxial cable having a feed inner conductor and a feed outer conductor that is electrically insulated from said feed inner conductor;

said first antenna element comprises a first coaxial cable having a first inner conductor and a first outer conductor that is electrically insulated from said first inner conductor, said first inner conductor and said first outer conductor each include said first proximate end and said first distal end;

said second antenna element comprises a second coaxial cable having a second inner conductor and a second outer conductor that is electrically insulated from said second inner conductor, said second inner conductor and said second outer conductor each include said second proximate end and said second distal end;

said feed outer conductor of said feed coaxial cable is electrically connected to said first distal end of said first outer conductor of said first coaxial cable;

said feed inner conductor of said feed coaxial cable is electrically connected to said first distal end of said first inner conductor of said first coaxial cable; and said first proximate end of said first inner conductor of said first coaxial cable is electrically connected to said second proximate end of said second outer conductor of said second coaxial cable.

17. An antenna structure, comprising:

a first antenna arm for receiving radio frequency waves, said first antenna arm having a first spiral shape and being defined by a first antenna element disposed in a first logarithmic periodic zig-zag configuration extending outwardly from a lateral center axis, said first logarithmic period zig-zag configuration contributing to the determination of a first bandwidth of said first antenna arm, wherein said first antenna arm receives said radio frequency waves about a first longitudinal center axis of said first antenna arm and said first logarithmic periodic zig-zag antenna element configuration;

a second antenna arm for receiving radio frequency waves, said second antenna arm having a second spiral shape and being defined by a second antenna element disposed in a second zig-zag configuration extending outwardly from said lateral center axis of said first antenna arm to provide reactive loading to said second antenna arm, wherein said second antenna arm receives said radio frequency waves about a second longitudinal center axis of said second antenna arm and said second zig-zag antenna element configuration, said first and second antenna arms disposed substantially uniformly about said lateral center axis; and feed means for conducting radio frequency signals from said first and second antenna elements, said feed means including an infinite balun.

18. The antenna structure of claim 17 wherein said first antenna element comprises a first single conductor and said second antenna element comprises a second single conductor.

19. The antenna structure of claim 17 wherein:

one of said first spiral shape and said second spiral shape is an equiangular spiral and said second zig-zag configuration is a logarithmic periodic configuration.

20. The antenna structure of claim 17, wherein:

said first antenna element comprises a first outer conductor of a first coaxial cable having a first proximate end located proximate to said lateral central axis and a second distal end located distal to said lateral central axis;

said second antenna element comprises a second outer conductor of a second coaxial cable having a second proximate end located proximate to said lateral central axis and a second distal end located distal to said lateral central axis; and said feed means includes a feed coaxial cable having a feed inner conductor and a feed outer conductor that is electrically insulated from said feed inner conductor.

21. The antenna structure of claim 17, wherein:

said first antenna element comprises a first metallization disposed on a surface of an insulating support member and has a first proximate end located proximate to said lateral center axis; and said second antenna element comprises a second metallization disposed on said surface of said insulating support member and has a second proximate end located proximate to said lateral center axis.

22. The antenna structure of claim 21, wherein said feed means includes:

a feed coaxial cable having a feed inner conductor electrically connected to one of said first proximate end of said first metallization and said second proximate end of said second metallization; and a feed outer conductor electrically connected to the other of said first proximate end of said first metallization and said second proximate end of said second metallization.

23. The antenna structure of claim 22 wherein:

said feed coaxial cable is positioned substantially coincident with one of said first longitudinal center axis of said first antenna arm and said second longitudinal axis of said second antenna arm.

24. The antenna structure of claim 23, said feed means further comprising:

a dummy coaxial cable positioned substantially coincident with the other of said first longitudinal center axis of said first antenna arm and said second longitudinal axis of said second antenna arm.

25. The antenna structure of claim 17 wherein said feed means is coupled to transmitting means whereby said first and second antenna arms are capable of transmitting radio frequency waves.

26. The antenna structure of claim 17, wherein said first and second antenna elements are disposed in a substantially coplanar fashion whereby the antenna structure achieves a substantially spherical radiation pattern.

27. An antenna structure, comprising:

a first antenna arm for receiving radio frequency waves, said first antenna arm having a first spiral shape and being defined by a first antenna element disposed in a first zig-zag configuration extending outwardly from a lateral center axis to provide reactive loading to said first antenna arm, wherein said first antenna arm receives said radio frequency waves about a first longitudinal center axis of said first antenna arm and said first zig-zag antenna element configuration;

a second antenna arm for receiving radio frequency waves, said second antenna arm having a second spiral shape and being defined by a second antenna element disposed in a second zig-zag configuration extending outwardly from said lateral center axis of said first antenna arm to provide reactive loading to said second antenna arm, Wherein said second antenna arm receives said radio frequency waves about a second longitudinal center axis of said second antenna arm and said second zig-zag antenna element configuration, said first and second antenna arms disposed substantially uniformly about said lateral center axis;

feed means for conducting radio frequency signals from said first and second antenna elements, said feed means including an infinite balun;

said first antenna element comprises a first outer conductor of a first coaxial cable having a first proximate end located proximate to said lateral central axis and a second distal end located distal to said lateral central axis;

said second antenna element comprises a second outer conductor of a second coaxial cable having a second proximate end located proximate to said lateral central axis and a second distal end located distal to said lateral central axis;

said feed means includes a feed coaxial cable having a feed inner conductor and a feed outer conductor that is electrically insulated from said feed inner conductor;

said feed outer conductor of said feed coaxial cable is electrically connected to said first distal end of said first outer conductor of said first coaxial cable;

said feed inner conductor of said feed coaxial cable is electrically connected to said first distal end of a first inner conductor of said first coaxial cable; and said first proximate end of said first inner conductor of said first coaxial cable is electrically connected to said second proximate end of said second outer conductor of said second coaxial cable.

28. The antenna structure of claim 27, further including an insulative support member wherein:

said first and second coaxial cables are woven through openings in said support member.

29. An antenna structure comprising:

a first antenna arm for receiving radio frequency waves, said first antenna arm having a first spiral shape and being defined by a first antenna element disposed in a first zig-zag configuration extending outwardly from a lateral center axis to provide reactive loading to said first antenna arm, wherein said first antenna arm receives said radio frequency waves about a first longitudinal center axis of said first antenna arm and said first zig-zag antenna element configuration;

a second antenna arm for receiving radio frequency waves, said second antenna arm having a second spiral shape and being defined by a second antenna element disposed in a second zig-zag configuration extending outwardly from said lateral center axis of said first antenna arm to provide reactive loading to said second antenna arm, wherein said second antenna arm receives said radio frequency waves about a second longitudinal center axis of said second antenna arm and said second zig-zag antenna element configuration, said first and second antenna arms disposed substantially uniformly about said lateral center axis;

feed means for conducting radio frequency signals from said first and second antenna elements, said feed means including an infinite balun;

said first antenna element comprises a first outer conductor of a first coaxial cable having a first proximate end located proximate to said lateral central axis and a second distal end located distal to said lateral central axis;

said second antenna element comprises a second outer conductor of a second coaxial cable having a second proximate end located proximate to said lateral central axis and a second distal end located distal to said lateral central axis;

said feed means includes a feed coaxial cable having a feed inner conductor and a feed outer conductor that is electrically insulated from said feed inner conductor;

one of said feed inner conductor and said feed outer conductor of said feed coaxial cable is electrically connected to one of said first proximate end of said first outer conductor of said first coaxial cable and said second proximate end of said second outer conductor of said second coaxial cable; and the other of said feed inner conductor and said feed outer conductor of said feed coaxial cable is electrically connected to the other of said first proximate end of said first outer conductor of said first coaxial cable and said second proximate end of said second outer conductor of said second coaxial cable.

30. The antenna structure of claim 29 wherein:

said feed coaxial cable is positioned substantially coincident with one of said first longitudinal center axis of said first antenna arm and said second longitudinal axis of said second antenna arm.

31. The antenna structure of claim 30, said feed means further comprising:

a dummy coaxial cable positioned substantially coincident with the other of said first longitudinal center axis of said first antenna arm and said second longitudinal axis of second antenna arm.

32. An antenna structure for use in conjunction with a mobile receiver, the antenna structure comprising:

an insulating support member;

a first antenna arm for receiving radio frequency waves, said first antenna arm having a first equiangular spiral shape and being defined by a first antenna element comprising a first single conductor disposed on said support member in a first logarithmic periodic zig-zag configuration extending outwardly from a lateral center axis, said first logarithmic periodic zig-zag configuration contributing to the determination of a first bandwidth of said first antenna arm, wherein said first antenna arm receives said radio frequency waves about a first longitudinal center axis of said first antenna arm and said first logarithmic periodic zig-zag antenna element configuration;

a second antenna arm for receiving radio frequency waves, said second antenna arm having a second equiangular spiral shape and being defined by a second antenna element comprising a second single conductor disposed on said support member in a second logarithmic periodic zig-zag configuration extending outwardly from said lateral center axis of said first antenna arm, said second logarithmic periodic zig-zag configuration contributing to a determination of a second bandwidth of said second antenna arm, wherein said second antenna arm receives said radio frequency waves about a second longitudinal center axis of said second antenna arm and said second logarithmic periodic zig-zag antenna element configuration, said first and second antenna arms disposed substantially uniformly about said lateral center axis; and feed means for conducting radio frequency signals from said first and second antenna elements, said feed means including an infinite balun.

33. The antenna structure of claim 32 wherein: said first and second bandwidths respectively have first and second upper frequency limits of about 900 MHz and first and second lower frequency limits of about 50 MHz, said first and second upper frequency limits being substantially determined by the width of each of said first and said second antenna arms at a location proximate to said lateral center axis and said first and second lower frequency limits being substantially determined by the effective length of each of said first and said second antenna arms at a location distal to said lateral center axis.

34. The antenna structure of claim 33, wherein said first and said second single conductors have a combined length such that said first and second antenna arms are further capable of receiving radio frequency energy over a band from about 500 KHz to about 1600 KHz.

35. The antenna structure of claim 32, wherein said support member is secured between insulating roof material and insulating headliner material.

36. An antenna structure, comprising:

an antenna for transmitting/receiving radio frequency signals, said antenna including a first antenna arm that extends outwardly from a lateral center axis and includes a first logarithmic periodic element which extends laterally from a first longitudinal center axis of said first antenna arm to define a first spiral shape; and feed means for conducting radio frequency signals between said antenna and other circuitry;

wherein said logarithmic periodic element has a zig-zag configuration.

37. The antenna structure of claim 36, wherein:

said antenna includes a support member and said first antenna arm includes metallization disposed on a surface of said support member.

38. The antenna structure of claim 36, wherein:

an antenna for transmitting/receiving radio frequency signals, said antenna including a first antenna arm that extends outwardly from a lateral center axis and includes a first logarithmic periodic element which extends laterally from a first longitudinal center axis of said first antenna arm to define a first spiral shape; and feed means for conducting radio frequency signals between said antenna and other circuitry;

wherein said antenna includes a support member and said first logarithmic periodic element is woven through openings in said support member.

39. The antenna structure of claim 36, wherein:

said first spiral shape includes an equiangular spiral.

40. The antenna structure of claim 36, wherein:

said feed means includes a cable positioned substantially coincident with said first longitudinal center axis of said first antenna arm.

41. The antenna structure of claim 36, wherein:

said feed means includes an infinite balun.

42. The antenna structure of claim 36, wherein:

said antenna includes a second antenna arm that extends outwardly from said lateral center axis and includes a second logarithmic periodic element which extends laterally from a second longitudinal center axis of said second antenna arm to define a second spiral shape.

43. The antenna structure of claim 42, wherein:

said first and second antenna arms are positioned so that a point on said first antenna arm is located substantially 180° from a corresponding point on said second antenna arm relative to said lateral center axis.

44. The antenna structure of claim 42, wherein:

said feed means includes means for providing a substantially 180° phase shift between radio frequency signals conducted by said first antenna arm and second antenna arm.

45. The antenna structure of claim 42, wherein:

said first antenna arm and said second antenna arm are substantially coplanar.

46. The antenna structure of claim 42, wherein:

said feed means includes an active cable positioned substantially coincidental with said first longitudinal axis and a dummy cable positioned substantially coincidental with said second longitudinal axis.

* * * * *